US007986277B2

(12) United States Patent
Li

(10) Patent No.: US 7,986,277 B2
(45) Date of Patent: Jul. 26, 2011

(54) COMMUNICATION DEVICE WITH ROTATABLE ANTENNAS

(75) Inventor: Jiunn-Her Li, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 299 days.

(21) Appl. No.: 12/417,648

(22) Filed: Apr. 3, 2009

(65) Prior Publication Data

US 2010/0090926 A1 Apr. 15, 2010

(30) Foreign Application Priority Data

Oct. 14, 2008 (CN) ..... 2008 1 0304922

(51) Int. Cl.
*H01Q 1/24* (2006.01)
*H01Q 1/50* (2006.01)

(52) U.S. Cl. ..... 343/702; 343/906

(58) Field of Classification Search ..... 343/702, 343/906, 878, 880, 882, 888
See application file for complete search history.

(56) References Cited

U.S. PATENT DOCUMENTS

| | | | | |
|---|---|---|---|---|
| 5,576,720 | A * | 11/1996 | Gorenz et al. | 343/702 |
| 6,043,794 | A * | 3/2000 | Faulkner et al. | 343/872 |
| 6,710,747 | B1 * | 3/2004 | Chang | 343/702 |
| 7,532,167 | B2 * | 5/2009 | Liang et al. | 343/702 |
| 7,567,217 | B1 * | 7/2009 | Chen | 343/906 |
| 2008/0165078 | A1 * | 7/2008 | Song | 343/906 |

* cited by examiner

*Primary Examiner* — Hoang V Nguyen
(74) *Attorney, Agent, or Firm* — Frank R. Niranjan

(57) ABSTRACT

A communication device includes an enclosure and two antennas rotatably attached to each fixing member. The enclosure includes a pair of sidewalls and a pair of fixing members projecting from a first end portion of each of the sidewalls. Each fixing member includes a plurality of projections spaced from each other. Each of the antennas includes a main body including a first end portion and an adjusting member projecting from the first end portion to adjust the antenna to be in a preferable position to optimize transmission and reception of signals. Each adjusting member includes hooking portions with grooves defined therebetween. The projections move in the adjusting member, resulting in rotation of the antennas relative to the enclosure. Each of the projections is received in a corresponding groove to allow the pair of antennas to be in the preferable position.

14 Claims, 5 Drawing Sheets

COMMUNICATION DEVICE WITH ROTATABLE ANTENNAS

BACKGROUND

1. Technical Field

The present disclosure generally relates to communication devices, and more particularly to a communication device with rotatable antennas.

2. Description of Related Art

In communication devices such as access points (AP), mobile phones, and the like, an antenna is required to transmit and receive signals. A typical communication device includes a plurality of groups of antennas fixed thereon to optimize signal transceiving. However, production cost of the communication device is increased by the multiple antennas.

Therefore, a need exists in the industry to overcome the described limitations.

DETAILED DESCRIPTION

Figure 1:
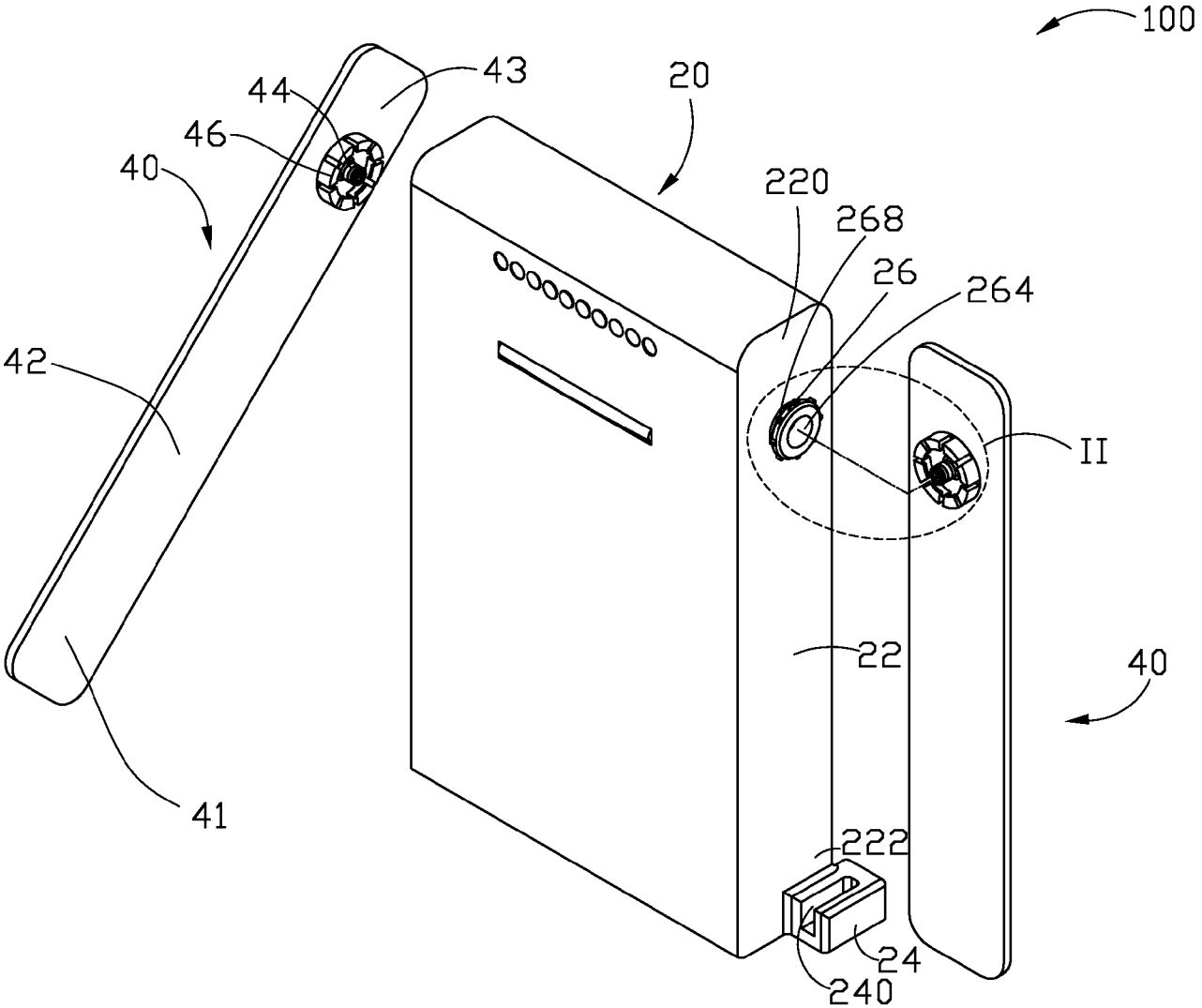
FIG. 1 is an exploded, isometric view of a communication device of an exemplary embodiment of the disclosure.

FIG. 1 is an exploded, isometric view of a communication device 100 of an exemplary embodiment of the present disclosure. The communication device 100 includes an enclosure 20 and a pair of antennas 40 rotatable relative to the enclosure 20. The communication device 100 is disclosed as an access point or a mobile internet device (MID), but the disclosure is not limited thereto.

The enclosure 20 accommodates electronic elements, such as printed circuit boards (PCBs), batteries, a central processing unit (CPU), etc. Although, the illustrated embodiment shows the enclosure 20 being substantially rectangular, it will be understood that other configurations may be utilized with equal applicability. The enclosure 20 includes a pair of sidewalls 22, a pair of fixing members 26 each projecting from a corresponding first end portion 220 of the sidewall 22, and a pair of receiving members 24 each projecting from a corresponding second end portion 222 of the sidewall 22 opposite to the first end portion 220.

Each of the pair of receiving members 24 defines a receiving groove 240 to receive a second end portion 41 of the antenna 40. Although, the illustrated embodiment shows each of the pair of receiving members 24 being substantially rectangular, it will be understood that other configurations may be utilized with equal applicability. When the second end portion 41 of each of the pair of antennas 40 is received in the receiving groove 240, each of the pair of antennas 40 is considered to be in an original position, in which each of the pair of antennas 40 cannot move freely, and as a result are protected from damage during transportation.

Figure 2:
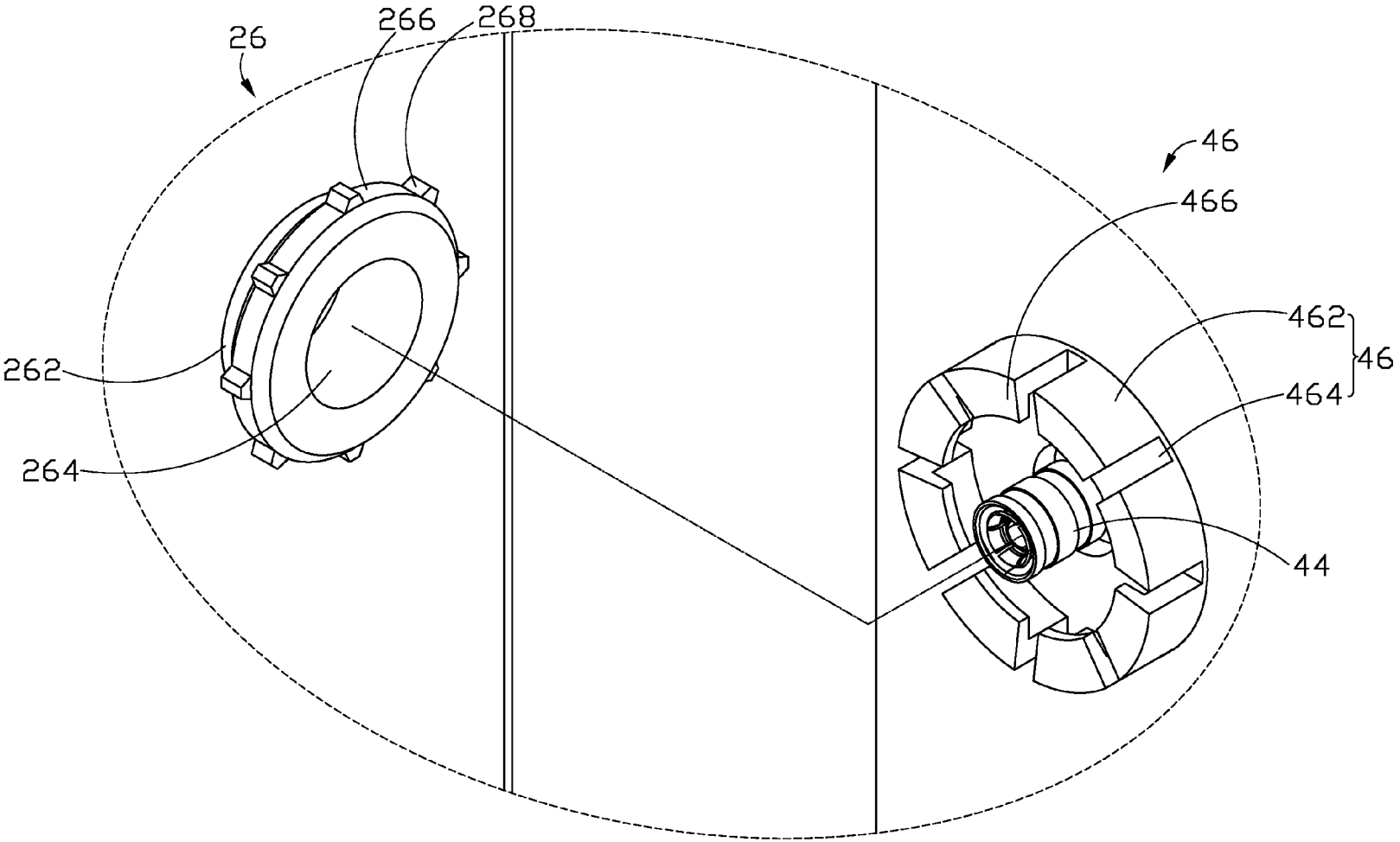
FIG. 2 is an enlarged view of a segment II of FIG. 1.

Referring to FIGS. 1-2, each of the pair of fixing members 26 includes a shaft 262, a through hole 264 extending through a central portion of the shaft 262, an annular flange 266 projecting from a periphery of the shaft 262, and a plurality of projections 268 spaced from each other and projecting from a periphery of the flange 266. In the illustrated embodiment, a cross-section of each of the plurality of the projections 268 is trapeziform.

Each of the pair of antennas 40 includes a main body 42, a connector 44 projecting from an interior surface of a first end portion 43 of the main body 42, and an adjusting member 46 surrounding the connector 44. An antenna module (not shown) is embodied in the main body 42 to transmit and receive signals. The connector 44 is electrically connected to a connector (not shown) in the enclosure 20 to electrically connect the antenna module of the antenna 40 and a printed circuit board (not shown) in the enclosure 20.

Each of the pair of adjusting members 46 adjusts a position of each of the pair of antennas 40. Each of the pair of adjusting members 46 includes a plurality of L-shaped hooking portions 462 and a plurality of grooves 464 defined between each two adjacent hooking portions 462 providing the plurality of hooking portions 462 with good resilience. Each of the plurality of hooking portions 462 includes a hook 466 positioned at a distal end portion thereof. The plurality of hooking portions 462 and the plurality of grooves 464 bound a circle, at the center of which the connector 44 is located. In the disclosure, eight hooking portions 462 and grooves 464 are angled 45° from each other. The number of grooves 464 equals the number of projections 268.

Alternatively, twelve or sixteen hooking portions 462 and grooves 464 can be utilized.

Figure 3:
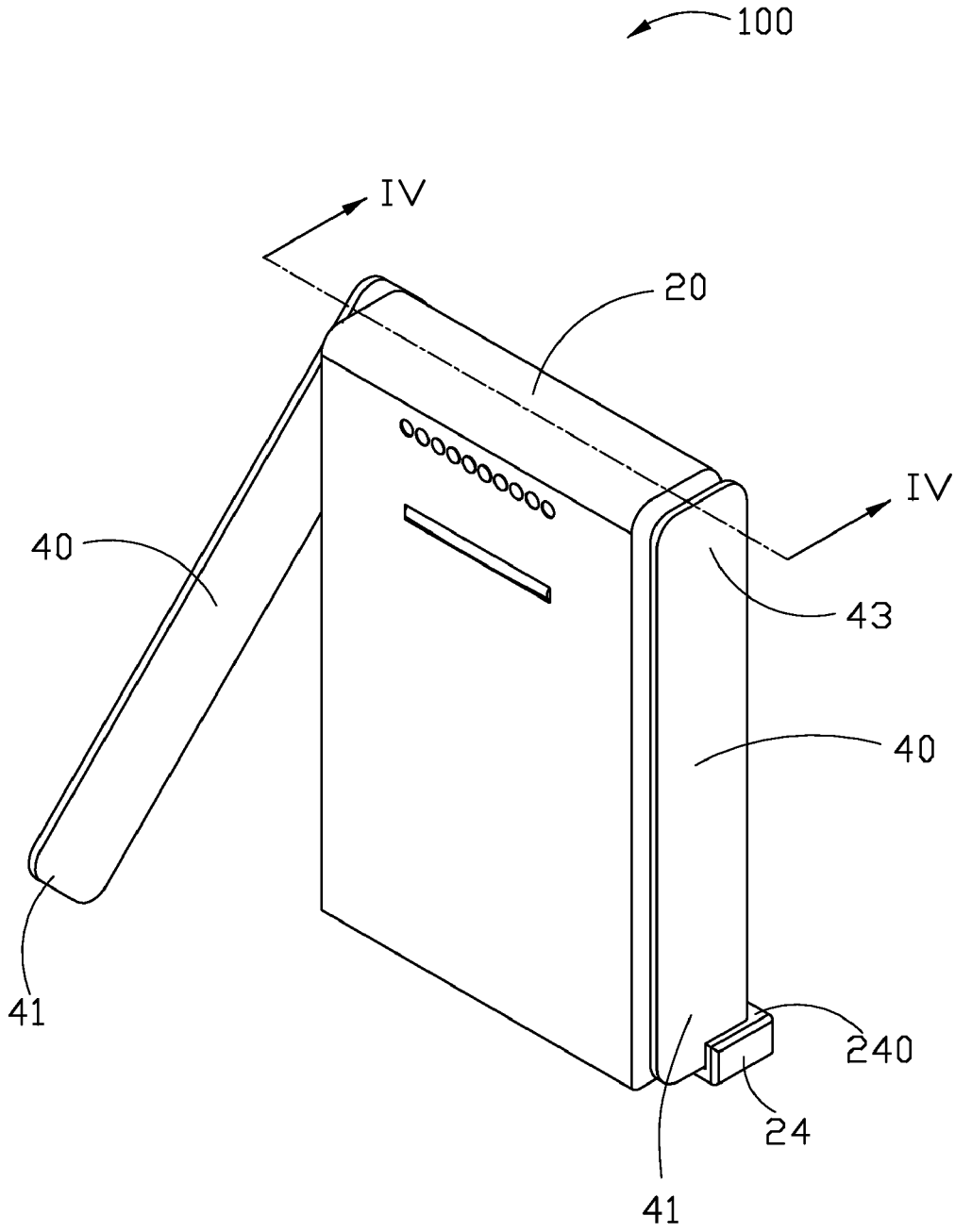
FIG. 3 is an assembled view of FIG. 1.
Figure 4:
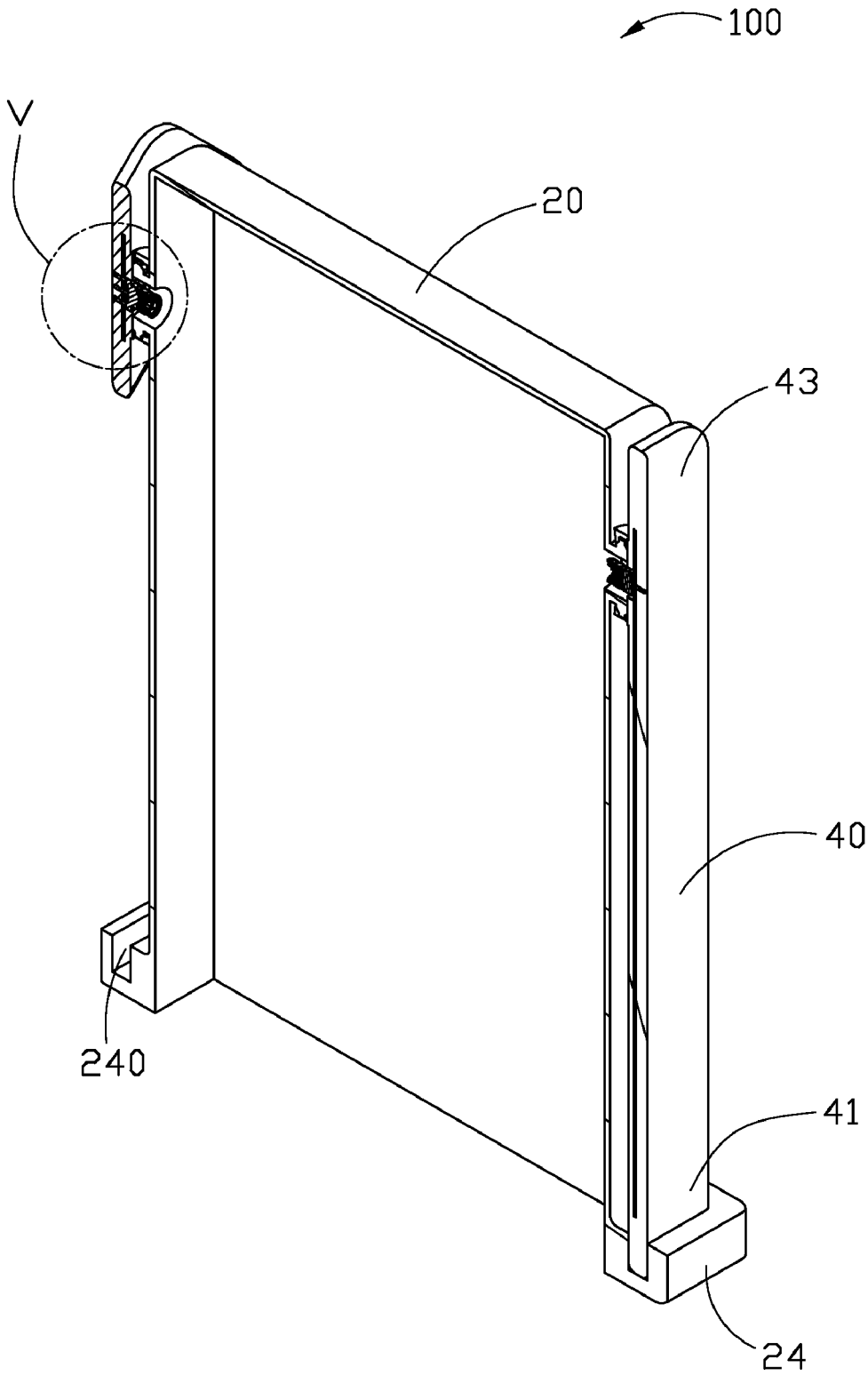
FIG. 4 is a cross-section along line IV-IV of FIG. 3.
Figure 5:
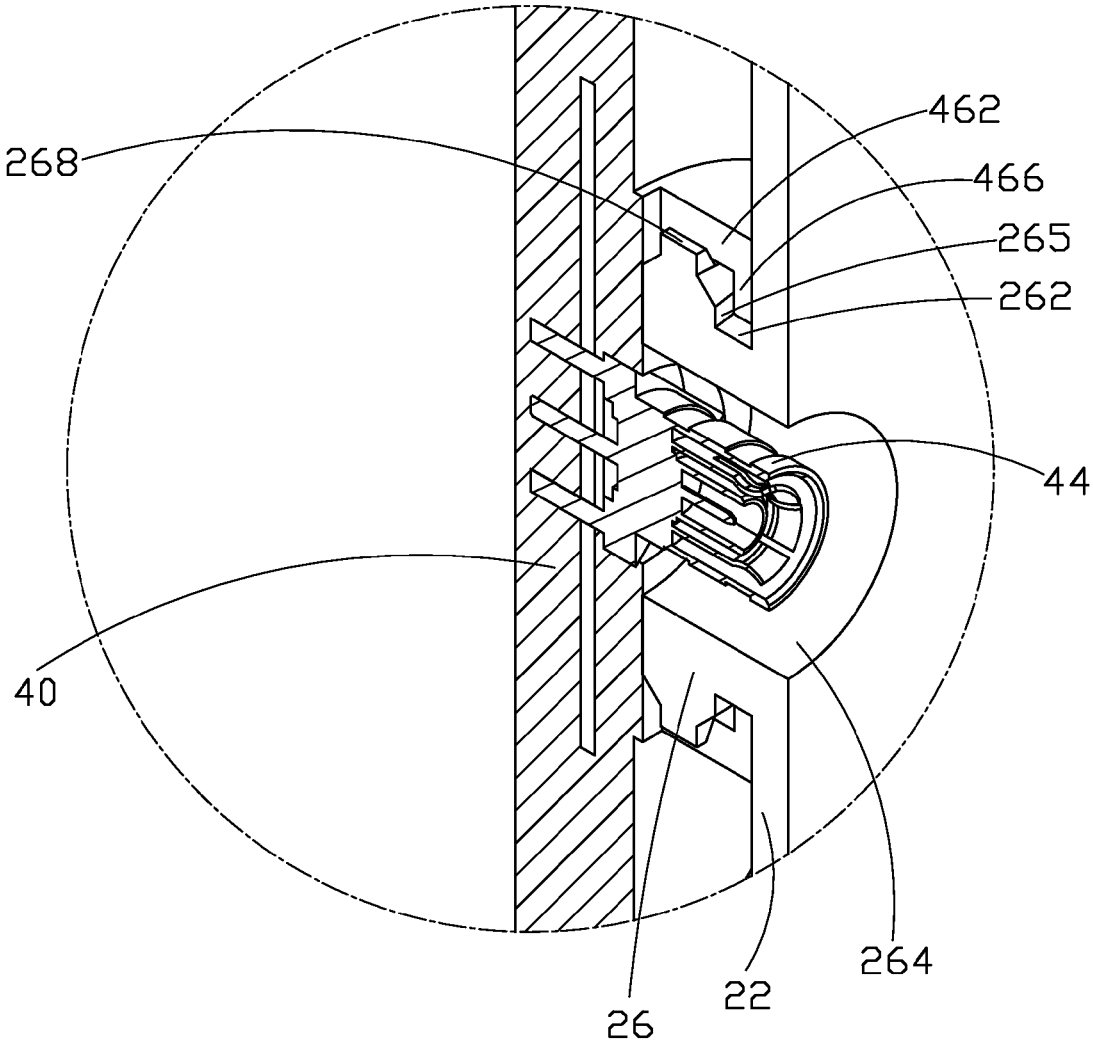
FIG. 5 is an enlarged view of a segment V of FIG. 4.

Referring to FIGS. 3-5, in assembly, the connector 44 of the antenna 40 is electrically connected to the printed circuit board of the enclosure 20. The plurality of projections 268 are received in corresponding grooves 464 with each of the plurality of hooks 466 clasping an end portion 265 of the flange 266. The second end portion 41 of each of the pair of antennas 40 is received in the receiving groove 240 of the receiving member 24, whereby the pair of antennas 40 and the enclosure 20 are assembled in the communication device 100.

In use, the plurality of projections 268 are moved in the adjusting member 46 so that the pair of antennas 40 rotate relative to the enclosure 20, adjustable to a preferable position to maximize transmission and reception of signals. While the antennas 40 are in the preferable position, the plurality of projections 268 are received in corresponding grooves 464 with each of the hooks 466 clasping the end portion 265 of the flange 266. Accordingly, the pair of antennas 40 can be freely rotated to allow adjustment thereof to the preferable position to optimize transmission and reception of signals.

Because each of the hooks 466 of the hooking portion 462 clasps the end portion 265 of a flange 266, the pair of antennas 40 cannot be accidentally dislodged from the fixing member 26 during use. In addition, the pair of antennas 40 can thereby be protected from damage.

Because the hooking portions 462 have good resilience, the projections 268 can easily disengage from the grooves 464. Thus the antennas 10 can be easily rotated.

While an embodiment of the present disclosure has been described, it should be understood that it has been presented by way of example only and not by way of limitation. Thus the breadth and scope of the present disclosure should not be limited by the above-described exemplary embodiments, but should be defined only in accordance with the following claims and their equivalents.

What is claimed is:

1. A communication device, comprising:

an enclosure accommodating a plurality of electronic elements therein, the enclosure comprising a pair of sidewalls and at least one fixing member projecting from a first end portion of one of the pair of sidewalls, wherein the at least one fixing member comprises a plurality of projections spaced from each other; and at least one antenna rotatably attached to the at least one fixing member, the at least one antenna comprising a main body comprising a first end portion and a second end portion opposite to the first end portion and an adjusting member projecting from the first end portion to adjust a position of the least one antenna, wherein the adjusting member comprises a plurality of hooking portions and a plurality of grooves between each two adjacent hooking portions;

wherein movement of the plurality of projections in the adjusting member allows rotation of the at least one antenna relative to the enclosure and adjusts the at least one antenna to be in a preferable position to optimize transmission and reception of signals, and wherein while the at lest one antenna is in the preferable position, the plurality of projections are received in the plurality of grooves.

2. The communication device as recited in claim 1, wherein the enclosure comprises at least one receiving member projecting from a second end portion of the one of the pair of sidewalls opposite to the first end portion, wherein the at least one receiving member defines a receiving groove to receive the second end portion of the at least one antenna.

3. The communication device as recited in claim 1, wherein the at least one fixing member comprises a shaft, a through hole extending through the shaft, and an annular flange projecting from a periphery of the shaft.

4. The communication device as recited in claim 3, wherein the plurality of projections projects from a periphery of the flange.

5. The communication device as recited in claim 4, wherein a cross-section of each of the plurality of projections is trapeziform.

6. The communication device as recited in claim 1, wherein the at least one the antenna comprises a connector surrounded by the at least one adjusting member.

7. The communication device as recited in claim 6, wherein each of the plurality of hooking portions is L-shaped, wherein each of the plurality of hooking portions comprises a hook positioned at in a distal end portion thereof.

8. A communication device, comprising:

an enclosure comprising a pair of sidewalls and a pair of fixing members each projecting from a first end portion of each of the pair of sidewalls, wherein each of the pair of fixing members comprises a plurality of projections spaced from each other; and a pair of antennas each rotatably attached to each of the pair of fixing members, each of the pair of antennas comprising a main body comprising a first end portion and a second end portion opposite to the first end portion and an adjusting member projecting from the first end portion to adjust the antenna to be in a preferable position to optimize transmission and reception of signals, wherein each of the pair of adjusting members comprises a plurality of hooking portions and a plurality of grooves defined between each two adjacent hooking portions;

wherein the plurality of projections move in the adjusting member, resulting in rotation of the pair of antennas relative to the enclosure, and wherein each of the plurality of projections is received in a corresponding groove to allow the pair of antennas to be in the preferable position.

9. The communication device as recited in claim 8, wherein the enclosure comprises a pair of receiving members projecting from a second end portion of each of the pair of sidewalls, wherein each of the pair of receiving members defines a receiving groove to receive the second end portion of the antenna.

10. The communication device as recited in claim 8, wherein each of the pair of fixing members comprises a shaft, a through hole extending through the shaft, and an annular flange projecting from a periphery of the shaft.

11. The communication device as recited in claim 10, wherein the plurality of projections projects from a periphery of the flange.

12. The communication device as recited in claim 11, wherein a cross-section of each of the projections is trapeziform.

13. The communication device as recited in claim 8, wherein each of the pair of antennas comprises a connector surrounded by the adjusting member.

14. The communication device as recited in claim 13, wherein each of the plurality of hooking portions is L-shaped, wherein each of the plurality of hooking portions comprises a hook positioned at a distal end portion thereof.

* * * * *